US011542451B2

(12) United States Patent
Asmatulu et al.

(10) Patent No.: US 11,542,451 B2
(45) Date of Patent: Jan. 3, 2023

(54) WATER IN FUEL NANOEMULSION AND METHOD OF MAKING THE SAME

(71) Applicant: Fuel Technology LLC, Wichita, KS (US)

(72) Inventors: Ramazan Asmatulu, Wichita, KS (US); Gohlam Abbas Aghakhani, Wichita, KS (US); Muhammad Mustafizur Rahman, Wichita, KS (US); Vinay Patil, Cedar Falls, IA (US)

(73) Assignee: Fuel Technology, LLC, Wichita, KS (US)

( * ) Notice: Subject to any disclaimer, the term of this patent is extended or adjusted under 35 U.S.C. 154(b) by 0 days.

(21) Appl. No.: 16/639,638

(22) PCT Filed: Aug. 19, 2018

(86) PCT No.: PCT/US2018/047013

§ 371 (c)(1),
(2) Date: Feb. 17, 2020

(87) PCT Pub. No.: WO2019/036695

PCT Pub. Date: Feb. 21, 2019

(65) Prior Publication Data

US 2020/0172822 A1 Jun. 4, 2020

Related U.S. Application Data

(60) Provisional application No. 62/547,136, filed on Aug. 18, 2017.

(51) Int. Cl.
*C10L 1/32* (2006.01)

(52) U.S. Cl.
CPC ..... *C10L 1/328* (2013.01); *C10L 2200/043* (2013.01); *C10L 2200/0446* (2013.01); *C10L 2250/086* (2013.01); *C10L 2270/026* (2013.01); *C10L 2270/04* (2013.01); *C10L 2290/24* (2013.01)

(58) Field of Classification Search
CPC .... C10L 1/1608; C10L 1/1616; C10L 1/1824; C10L 1/1826; C10L 1/191; C10L 1/1985; C10L 1/328; C10L 2200/0423; C10L 2200/043; C10L 2200/0438; C10L 2200/0446; C10L 2230/082; C10L 2250/084; C10L 2250/086; C10L 2270/026; C10L 2270/04; C10L 2290/24; C10L 10/02
See application file for complete search history.

(56) References Cited

U.S. PATENT DOCUMENTS

2013/0219772 A1* 8/2013 Fujita ..... C10L 1/328 44/301

FOREIGN PATENT DOCUMENTS

WO WO-2015200381 A1 * 12/2015 ..... A61K 9/107

* cited by examiner

*Primary Examiner* — Latosha Hines
(74) *Attorney, Agent, or Firm* — James A. Italia; Italia IP

(57) ABSTRACT

A method of producing a nanoemulsion is disclosed that provides an oleaginous base fuel, and water in an amount of at least 10 wt %. A first nonionic surfactant, a second nonionic surfactant and a third nonionic surfactant are mixed in substantially equal weight ratios into a surfactant mixture. The surfactant mixture is mixed with the water and the base fuel to form the nanoemulsion fuel. A nanoemulsion fuel composition can comprise an external oleaginous phase comprised of base fuel, an internal aqueous phase comprised of water, and a surfactant mixture comprised of a plurality of surfactants. The first surfactant can be derived from ethylene oxide, the second surfactant and the third surfactant are detergents having a fatty acid.

4 Claims, No Drawings

WATER IN FUEL NANOEMULSION AND METHOD OF MAKING THE SAME

CROSS REFERENCE TO RELATED APPLICATIONS

This National Stage Application is filed under 35 U.S.C. 371 and claims priority to PCT Application No. PCT/US2018/047013 filed Aug. 19, 2018, which claimed priority to U.S. Provisional Application No. 62/547,136, filed Aug. 18, 2017, the contents of which are all incorporated by reference herein in their entirety.

BACKGROUND OF THE DISCLOSURE

The demand for hydrocarbon is increasing even as alternative energy sources become more common. Transportation is still a major use of energy and demand for fuels used for transportation, jet fuel and diesel, for example, continues to rise. Use of these fuels generates emissions that can cause increased carbon dioxide in the atmosphere, which has been cited as a cause of global warming.

Increasing the efficiency of fuel can be obtained by adding water to the fuel or injecting water into the intake of an engine. Creating an emulsion of water in diesel fuel is an example fuel that has been used to reduce the emission pollution for combustion engines. However, these known fuel emulsions only permit a limited water ratio and are not as stable as a nanoemulsion.

SUMMARY OF THE DISCLOSURE

The present disclosure is directed to a composition and method for producing a nanoemulsion comprising fuel and water. The composition and method can produce a transparent and stable water in fuel nanoemulsion. The disclosure is directed to various surfactants and water contents that may be usable to improve fuel efficiency and reduced carbon emissions that plague known fuels. The particulars described herein are by way of example and for purposes of illustrative discussion of the examples of the subject disclosure only and are presented in the cause of providing what is believed to be the most useful and readily understood description of the principles and conceptual aspects of the subject disclosure.

DETAILED DESCRIPTION

The present disclosure is directed to a composition and method for producing a nanoemulsion comprising fuel and water. The composition and method can produce a transparent and stable water in fuel nanoemulsion. The disclosure is directed to various surfactants and water contents that may be usable to improve fuel efficiency and reduced carbon emissions that plague known fuels. The particulars described herein are by way of example and for purposes of illustrative discussion of the examples of the subject disclosure only and are presented in the cause of providing what is believed to be the most useful and readily understood description of the principles and conceptual aspects of the subject disclosure.

Advantageously and unexpectedly, the method of mixture of emulsifiers or surfactants and the ratio of the emulsifiers or surfactants permits a stable nanoemulsion of various water contents with various base fuels. The nanoemulsion can be kinetically stable and can include small droplet sizes ranging from 10-200 nanometers. The present disclosure advantageously and unexpectedly discloses a formulation and method of producing a nanoemulsion that is applicable to various oleaginous fluids or fuels, including but not limited to natural or synthetic oils, selected from a group that may include diesel, biodiesel, gasoline, kerosene, mineral oil, synthetic oils, fuel oils, such as bunker oil, jet oil, and heating oil.

The nanoemulsion of the disclosure can comprise an oleaginous external phase and an aqueous internal phase that are stabilized by one or more surfactants. The internal phase of the nanoemulsion may comprise an aqueous internal phase, such as fresh water, sea water, tap water and treated water, such as Filtered, reverse osmosis (RO), de-ionized (DI), protonated, alkaline and plasma treated water. Advantageously and unexpectedly, the nanoemulsion is capable having a high-water content. For example, the nanoemulsion may have percent by weight (wt %) of aqueous internal phase in a range having a lower limit selected from any of 10 wt %, 15 wt %, 20 wt %, 25 wt %, and 30% wt to an upper limit selected from any of 30 wt %, 35 wt %, 40 wt %, 45 wt %, and 50 wt %.

In one or more embodiments, the nanoemulsion may have percent by weight (wt %) of oleaginous external phase in a range having a lower limit selected from any of 35 wt %, 40 wt %, and 45 wt % to an upper limit selected from any of 50 wt %, 55 wt %, 60 wt %, 70 wt %, and 80 wt %.

In an embodiment, a mixture of surfactants will be used with oleaginous external phase and an aqueous internal phase to form the nanoemulsion. As an example, the surfactants may comprise one or more nonionic surfactant. The nonionic surfactants can be combined in a ratio to provide a synergistic effect to permit stable emulsions with significant water ratios. The surfactants may be soluble in water, miscible in organic solvents and/or insoluble in aliphatic hydrocarbons. The surfactants may have an amphipathic structure comprising a polar, hydrophilic "head" region and a non-polar hydrophobic "tail" region. In one or more embodiments, the surfactants may include a mixture of esters from fatty acids, including but not limited to stearic acid, lauric acid, oleic acid, palmitic acid and linolenic acid. In one or more embodiments, the surfactants may be derived from sorbitol, polyols form sorbitol, glycol, including but not limited to ethylene glycol, any polymer of ethylene glycol, or other alcohol.

In one or more embodiments, the surfactants can comprise one or more of the following sorbitan monolaurate ("Span 20"), sorbitan sesquioleate ("Span 83"), sorbitan monooleate ("Span 80"), polyoxyethylene (6) sorbitan monolaurate ("Tween 21"), polyoxyethylene (6) sorbitan monooleate ("Tween 81"), polyoxyethylene (20) sorbitan monostearate ("Tween 60"), polyoxyethylene (20) sorbitan monooleate ("Tween 80"), polyoxyethylene (20) sorbitan trioleate ("Tween 85"), polyethylene glycol (10EO) monostearate ("MYS 10"), polyethylene glycol (10EO) monolaurate ("MYL 10"), polyethylene glycol (25EO) monostearate ("MYS 25"), polyethylene glycol distearate ("CDS-400"), polyethylene glycol diisostearate ("CDIS-400"), tetraglycerol monooleate ("MO-310"), hexaglycerol monooleate ("MO-500"), tetraglycerol monolaurate ("ML-310"), tetraglycerol monosterate ("MS-310"), hexaglycerol sesquistearate ("SS-500"), decaglycerol tristearate ("TS-750"), and 4-(1,1,3,3-Tetramethylbutyl) phenyl-polyethylene glycol, t-Octylphenoxypolyethoxyethanol, Polyethylene glycol tert-octylphenyl ether ("Triton X-100").

In one or more embodiments, a first surfactant used in the nanoemulsion has a HLB value in a range having a lower limit selected from any of 2.5, 3, 3.5 and 4 to an upper limit selected from any of 4, 4.5, 5, 5.5, and 6. In one or more embodiments, the first surfactant has a HLB value of around 4. In one or more embodiments, a second surfactant may be used with or without the first surfactant.

The second surfactant can have a HLB value in a range having a lower limit selected from any of 13, 14, and 15 to an upper limit selected from any of 15, 16 and 17. In one or more embodiments, the second surfactant has a HLB value of around 15. Furthermore, in one or more embodiments, a third surfactant can be used in the nanoemulsion with or without the first surfactant and the second surfactant. The third surfactant can have a HLB value in a range having a lower limit selected from any of 10, 11, 12, 13 to an upper limit selected from any of 13, 14, 15, 16.

In one or more embodiments, the first surfactant, the second surfactant and the third surfactant are provided in the nanoemulsion in equal weight percent. In one or more embodiment, the weight percent of the surfactants in the nanoemulsion can have a range having a lower limit selected from any of 4, 5, 6, and 7 weight percent to an upper limit selected from any of 6, 7, 8, 9, 10, 11, 12, and 13 weight percent.

Additives may be included in the nanoemulsion. For example, a first additive may be applied to prevent freezing. In one or more embodiments, the first additive may be glycol based, including but not limited to ethylene glycol. The first additive ethylene glycol destabilizes the aqueous internal phase so as not to freeze at low temperatures. In one or more embodiment, the weight percent of the first additive in the nanoemulsion can have a range having a lower limit selected from any of 1, 2, 3, 4, 5 weight percent to an upper limit selected from any of 5, 6, and 7 weight percent.

A second additive may be provided to improve burning efficiency, depending on the use of the nanoemulsion. In one or more embodiments, the second additive may be alkane hydrocarbon, such as an acyclic saturated hydrocarbon, including but not limited to hexadecane (cetane). The second additive may have a range having a lower limit selected from any of 0.5, 0.75, and 1 weight percent to an upper limited selected from any of 0.75, 1, 2 and 3.

A third additive may be provided as a defoamer to prevent or reduce foam within the nanoemulsion. The third additive can be immiscible in water. In one or more embodiment, the third additive may comprise an alcohol with an alkane, including but not limited to 1-octanol, 2-octanol, 2-ethylhexanol, or other de-foaming agents. The third additive may have a range having a lower limit selected from any of 0.01, 0.05, 0.1 weight percent to an upper limited selected from any of 0.075, 0.1, 0.2 and 0.3 weight percent.

The method of producing the nanoemulsion fuel can be produced using a specific process that may be modified based on the use of the nanoemulsion fuel, base fuel used and/or desired weight percent water. The unexpected process provides a method that is applicable over a range of fuels and a weight percent range of aqueous fluid.

Aqueous fluid, such as water, is added during the nanoemulsion process to produce fuels with the respective water content desired. Oleaginous fluid, such as fuel, is added in the desired weight percent. Each oleaginous fluid or fuel has different specific processing parameters and conditions to produce different nanoemulsion fuels.

This process can provide a unique ratio of surfactants with agitation to provide a nanoemulsion usable as a fuel. Degassing of the nanoemulsion fluid through processing in a vacuum desiccator or planetary vacuum mixer and/or addition of the third additive can prevent gas and/or entrapped air bubbles in the nanoemulsion fluid and can produce improved and stable fuels.

In addition to the unexpected combination of surfactants, the disclosure provides a method of producing a nanoemulsion with the use of elevated temperatures in the process. High temperature and pressure systems can be combined, and different sonication wavelengths (e.g., microwave and other wavelengths) or heat sources can be used for the nanoemulsion process in order to improve nanofuel production systems. For example, microwave and/or any other heat sources can enhance the nanoemulsion process. In one or more embodiments, the process uses temperatures that can range from a lower limit selected from any of 30, 35, 40, and 45 degrees Celsius to an upper limit selected from any of 45, 50, 55, 60 and 70 degrees Celsius to provide the nanoemulsion fuel.

The examples below illustrate that many different nanoemulsion fuels can be obtained by changing the processing parameters for each fuel. Chemical formulations, processing parameters, and production steps are the key parameters to produce nanoemulsion fuels. The nanoemulsion fuels set forth in the examples present new fuels that will not only improve the fuel efficiency and engine performance, but also reduce the various emissions, such as NOx, CO, $CO_2$, and particulate matters from combustion engines and fuel burners.

In various other embodiments of the disclosure, specific step-by-step processes can produce stable nanoemulsion fuels. The nanoemulsion can be used in transportation, energy, and petroleum industries to provide environmentally friendlier fuels. Specifically, transportation (car, aircraft, ship, train, truck, heavy machineries, and so on), fuel burners, power plants, steam generators, household heating, and various other chemical and biomedical industries can benefit from this process.

Although only a few examples are set forth in detail, those skilled in the art will readily appreciate that many modifications are possible in the examples without materially departing from this subject disclosure. Accordingly, all such modifications are intended to be included within the scope of this disclosure as defined in the claims.

Examples

In several of the following examples, results are significantly improved by adding the third additive. For example, a few drops (e.g., 2 drops or about 0.1 wt %) of octanol (e.g., an alcohol with a formula CsHnOH) is added to the mixture. In certain examples, the total amount of octanol is about 0.1 wt %.

In the Examples, note that: Fuel #1 is Jet Fuel sourced from Hampel Oil, Wichita, Kans.; Fuel #2 is Diesel Fuel sourced from QT Station®, Wichita, Kans.; Fuel #6 is Bunker Oil sourced from Bomin® Bunker Oil Corp, TX; and, Fuel #4 is 1:1 mixture of Bunker Oil (Fuel #6) and Diesel Fuel (Fuel #2).

Example A (Diesel Fuel with 30 wt % Water Content)

Step #1: Put the following items into ajar with a lid:

35 g Diesel (QT Station®, Wichita, Kans.)

24 g Filtered Brita® Water 6 g Triton X-100+Span 80+Tween 80 solution (prepare a mixture of Triton X-100+Span 80+Tween 80 at 1:1:1 weight ratio)

1 g Hexadecane (HD)
4 g Ethylene Glycol
2 drops of octanol (0.1 wt %)

Sonicate the above mixture for 10 mins to obtain a homogeneous milky product at room temperature or 40-50° C. (microwave heat).

Step #2: Take 10 ml mixture of the Triton X-100+Span 80 solution (1:1), weigh them to find the actual weights, and add it drop-wise into the previous solution using a sonicator at room temperature or 40-50° C. (microwave heat). Total surfactant use (Triton X-100+Span 80) is about 9 g in the second step. Increase the sonication time and temperature, resulting in a more stable nanoemulsion. Clear nanoemulsion fuel is observed when the temperature of the nanoemulsion fuel is reduced to room temperature.

Results: Freezing tests between 50 C and −8 C validate that this Example avoids any unacceptable turbidity/cloudiness, phase separation, and viscosity changes. Burning tests demonstrate acceptable burning.

Example B (Diesel Fuel with 40 wt % Water Content)

Step #1: Put the following items into ajar with a lid:
35 g Diesel (QT Station®, Wichita, Kans.)
39 g Filtered Brita® Water
6 g Triton X-100+Span 80+Tween 80 solution (prepare a mixture of Triton X-100+Span 80+Tween 80 at 1:1:1 weight ratio)
1.33 g Hexadecane (HD)
5.34 g Ethylene Glycol
2 drops of octanol (0.1 wt %)

Sonicate the above mixture for 10 mins to obtain a homogeneous milky product at room temperature or 40-50° C. (microwave heat).

Step #2: Take 10 ml mixture of the Triton X-100+Span 80 solution (1:1), weigh them to find the actual weights, and add it drop-wise into the previous solution using a sonicator at room temperature or 40-50° C. (microwave heat). Total surfactant use (Triton X-100+Span 80) is about 12.5 g in the second step. Increase the sonication time and temperature, resulting in a more stable nanoemulsion. Clear nanoemulsion fuel is observed when the temperature of the nanoemulsion fuel is reduced to room temperature.

Results: Freezing tests between 50 C and −8 C validate that this example avoids any unacceptable turbidity/cloudiness, phase separation, and viscosity changes. Burning tests demonstrate acceptable burning.

Example C (Diesel Fuel with 22 wt % Water Content)

Step #1: Put the following items into ajar with a lid:
35 g Diesel (QT Station®, Wichita, Kans.)
14 g Filtered Brita® Water
5 g Triton X-100+Span 80+Tween 80 solution (prepare a mixture of Triton X-100+Span 80+Tween 80 at 1:1:1 weight ratio)
1 g Hexadecane (HD)
3.5 g Ethylene Glycol
2 drops of octanol (0.1 wt %)

Sonicate the above mixture for 10 mins to obtain a homogeneous milky product at room temperature or 40-50° C. (microwave heat).

Step #2: Take 10 ml mixture of the Triton X-100+Span 80 solution (1:1), weigh them to find the actual weights, and add it drop-wise into the previous solution using a sonicator at room temperature or 40-50° C. (microwave heat). Total surfactant use (Triton X-100+Span 80) is about 6 g in the second step. Increase the sonication time and temperature, resulting in a more stable nanoemulsion. Clear nanoemulsion fuel is observed when the temperature of the nanoemulsion fuel is reduced to room temperature.

Results: Freezing tests between 50° C. and −8° C. validate that this example avoids any unacceptable turbidity/cloudiness, phase separation, and viscosity changes. Burning tests demonstrate acceptable burning.

Example D (Fuel Oil #1 is Jet Fuel)

Step #1: Put the following items into ajar with a lid:
40 g Fuel Oil #1 (Jet Fuel from Hampel Oil®, Wichita, Kans.)
40 g Filtered Brita® Water
6 g Triton X-100+Span 80+Tween 80 solution (prepare a mixture of Triton X-100+Span 80+Tween 80 at 1:1:1 weight ratio)
1 g Hexadecane (HD)
0, 2, 4, and 8 g Ethylene Glycol (four separate sub examples)

Sonicate the above mixture for 10 mins (20% power on a Sonics® 130 W Ultrasonic Processor Sonicator (Model VCX 130 PB)) to obtain a homogeneous milky product at both room temperature and 40-50° C.

Step #2: Take 10 ml mixture of the Triton X-100+Span 80 solution (1:1), weigh them to find the actual weights, and add it drop-wise into the previous solution using a sonicator. Stop adding these surfactants when nanofuel mixture turns clear. Total surfactant use (Triton X-100+Span 80) is about 12 g in the second step. Increase the sonication time and temperature, resulting in a more stable nanoemulsion. 2 and 4 g of Ethylene Glycol provides better nanoemulsion fuels.

Results: Freezing tests between 22° C. and 0° C. validate that this example avoids any unacceptable turbidity/cloudiness, phase separation, and viscosity changes. Burning tests demonstrate acceptable burning.

Example E (Fuel Oil #4)

Step #1: Put the following items into ajar with a lid:
62 g Fuel Oil #4 (obtained from Bunker Oil (Fuel #6) well mixed with Diesel (Fuel #2) at a 1:1 ratio)
38 g Filtered Brita® Water
6 g Triton X-100+Span 80+Tween 80 solution (prepare a mixture of Triton X-100+Span 80+Tween 80 at 1:1:1 weight ratio)
1 g Hexadecane (HD)
0, 2, 4, and 8 g Ethylene Glycol (four separate sub examples)

Sonicate the above mixture for 10 mins to obtain a homogeneous product (may not be clear because of the black color of the fuel) at both room temperature and 40-50° C.

Results: Freezing tests between 22° C. and 0° C. validate that this example avoids any unacceptable turbidity/cloudiness, phase separation, and viscosity changes. Burning tests demonstrate acceptable burning.

Example F (Bunker Oil—Ship Fuel (Bomin® Bunker Oil Corp, TX))

Step #1: Put the following items into ajar with a lid:
55 g Bunker Oil
40 g Filtered Brita® Water 3 g Triton X-100+Span 80+Tween 80 solution (prepare a mixture of Triton X-100+Span
80+Tween 80 at 1:1:1 weight ratio)
1 g Hexadecane (HD)
1 g Ethylene Glycol The above mixture was sonicated for 10 mins (20% power on a Sonics® 130 W Ultrasonic Processor Sonicator (Model VCX 130 PB)) to obtain a homogeneous product (may not be clear because of the black color of the fuel) at both room temperature and 40-50° C.

Step #2: 10 ml mixture of the Triton X-100+Span 80 solution (1:1), was weighed to determine the actual weights, and added drop-wise into the previous solution using a sonicator.

Step #3: 4 ml of above mixture was put into four separate vials and respectively add 0, 5, 10, and 15 wt % of Ethylene Glycol (four separate subexamples) and vortex/handshake for 1-2 minutes.

Results: Freezing tests between 22 C and 0° C. validated that this example avoided any unacceptable turbidity/cloudiness, phase separation, and viscosity changes. Burning tests demonstrate acceptable burning.

Example G

Step #1: Put the following items into ajar with a lid:
42 g Pure Kerosene (Ace Hardware®, Wichita, Kans.)
40 g Filtered Brita® Water
6 g Triton X-100+Span 80+Tween 80 solution (prepare a mixture of Triton X-100+Span
80+Tween 80 at 1:1:1 weight ratio)
0.5 g Hexadecane
0.5 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N).

As soon as you see the clear nanofuel, stop adding these surfactants, and find out the actual weights of Triton X-100 and Span 80 mixture that you used in this step.

Step #3: Freezing tests between 22 C and 0° C. in a freezer were conducted to determine presence of turbidity/cloudiness, phase separation, and viscosity changes.

Step #4: Burning tests in a beaker with a paper or cloth were conducted to determine how well the nanoemulsion burned.

Results: The above emulsion was mixed well, and test results were good (stable and clear nanoemulsion fuel). This was deemed a successful test.

Example H

Step #1: Put the following items into ajar with a lid:
42 g Fuel Oil #1 (Jet Fuel sourced from Hampel Oil®, Wichita, Kans.)
40 g Filtered Brita® Water
6 g Triton X-100+Span 80+Tween 80 solution (prepare a mixture of Triton X-100+Span 80+Tween 80 at 1:1:1 weight ratio)
0.5 g Hexadecane
0.5 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N).

As soon as you see the clear nanofuel, stop adding these surfactants, and find out the actual weights of Triton X-100 and Span 80 mixture that you used in this step.

Step #3: Freezing tests between 22° C. and 0° C. in a freezer were conducted to determine presence of turbidity/cloudiness, phase separation, and viscosity changes.

Step #4: Burning tests in a beaker with a paper or cloth were conducted to determine how well the nanoemulsion burned.

Example I

Step #1: Put the following items into ajar with a lid:
40 g Fuel Oil #1 (Jet Fuel sourced from Hampel Oil®, Wichita, Kans.)
40 g Filtered Brita® Water
3 g Triton X-100+Span 80+Tween 80 solution (prepare a mixture of Triton X-100+Span
80+Tween 80 at 1:1:1 weight ratio)
3 g Liquid Dishwasher (Liquid Soap)
1 g Hexadecane
1 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80+Liquid Dishwasher solution (25:25:50), weigh them to find the actual weights, and add it dropwise into the previous solution while sonicating the solution with a 300 W Ultrasonic Processor Sonicator (Model MSK-USP-3N). During the homogenization, pay attention about the color changes in the nanoemulsion.

Step #3: Freezing tests were conducted between 22 C and 0° C. in a freezer to determine presence of turbidity/cloudiness, phase separation, and viscosity changes.

Step #4: Burning tests in a beaker with a paper or cloth were conducted to determine how well the nanoemulsion burned.

Example J

Step #1: Put the following items into ajar with a lid:
40 g Fuel Oil #1 (Jet Fuel sourced from Hampel Oil®, Wichita, Kans.)
40 g Filtered Brita® Water
6 g Triton X-100+Span 80+Tween 80 solution (prepare a mixture of Triton X-100+Span 80+Tween 80 at 1:1:1 weight ratio)
1 g Hexadecane
1 g Ethylene Glycol Homogenize the above mixture at 35,000 rpm for 10 mins using a homogenizer. Make sure that you get homogeneous milky product in this step. In this step, please don't use sonication.

Step #2: Take 10 ml mixture of the Triton X-100+Span 80 solution, weigh them to find the actual weights, and add it drop-wise into the previous solution while homogenizing the solution.

During the homogenization, pay attention about the color changes in the nanoemulsion.

Step #3: Freezing tests between 22 C and 0° C. in a freezer were conducted to determine presence of turbidity/cloudiness, phase separation, and viscosity changes.

Step #4: Burning tests in a beaker with a paper or cloth were conducted to determine how well the nanoemulsion burned.

Results: The above emulsion was mixed well, and test results were good (stable and clear nanofuel). This was deemed a successful test, but this results were not as good as Fuel Oil #1 Test 7 (Jet Fuel) test above.

Example K

Step #1: Put the following items into ajar with a lid:

40 g Fuel Oil #1 (Jet Fuel sourced from Hampel Oil®, Wichita, Kans.)

40 g Filtered Brita® Water 6 g Triton X-100+Span 80+Tween 80 solution (prepare a mixture of Triton X-100+Span 80+Tween 80 at 1:1:1 weight ratio)

1 g Hexadecane 1 g Ethylene Glycol

Sonicate the above mixture for 10 mins using a 300 W Ultrasonic Processor Sonicator (Model MSK-USP-3N). Make sure that you get homogeneous milky product in this step.

Step #2: Take 10 ml mixture of the dishwasher liquid solution, weigh them to find the actual weights, and add it drop-wise into the previous solution using a 300 W Ultrasonic Processor Sonicator (Model MSK-USP-3N).

Step #3: Freezing tests between 22° C. and −22° C. in a freezer were conducted to determine presence of turbidity/cloudiness, phase separation, and viscosity changes.

Step #4: Burning tests in a beaker with a paper or cloth were conducted to determine how well the nanoemulsion burned.

Example L

Step #1: Put the following items into ajar with a lid:

40 g Fuel Oil #1 (Jet Fuel sourced from Hampel Oil®, Wichita, Kans.)

40 g Filtered Brita® Water 6 g Triton X-100+Span 80+Tween 80 solution (prepare a mixture of Triton X-100+Span 80+Tween 80 at 1:1:1 weight ratio)

1 g Hexadecane 0, 2, 4 and 8 g Ethylene Glycol (Four Tests)

Sonicate the above mixture for 10 mins using a Sonics® 130 W Ultrasonic Processor Sonicator (Model VCX 130 PB) at 20% power. Make sure that you get homogeneous milky product in this step. Later you can play with the amount of the hexadecane contents and other surfactants and solvents.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). As soon as you see the clear nanofuel, stop adding these surfactants, and find out the actual weights of Triton X-100 and Span 80 mixture that you used in this step. Make sure that the temperature of the solution in the sonicator is not too high.

Step #3: Freezing tests between 22° C. and −22° C. in a freezer were conducted to determine presence of turbidity/cloudiness, phase separation, and viscosity changes.

Step #4: Burning tests in a beaker with a paper or cloth were conducted to determine how well the nanoemulsion burned.

Example M

Step #1: Put the following items into ajar with a lid:

40 g Fuel Oil #1 (Jet Fuel sourced from Hampel Oil®, Wichita, Kans.)

40 g Filtered Brita® Water 6 g Triton X-100+Span 80+Tween 80 solution (prepare a mixture of Triton X-100+Span 80+Tween 80 at 1:1:1 weight ratio)

1 g Hexadecane 1 g Ethylene Glycol

Sonicate the above mixture for 10 mins using a Sonics® 130 W Ultrasonic Processor Sonicator (Model VCX 130 PB) at 20% power. Make sure that you get homogeneous milky product in this step.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). As soon as you see the clear nanofuel, stop adding these surfactants, and find out the actual weights of Triton X-100 and Span 80 mixture that you used in this step. Make sure that the temperature of the solution in the sonicator is not too high.

Step #3: Freezing tests between 22° C. and −22° C. in a freezer were conducted to determine presence of turbidity/cloudiness, phase separation, and viscosity changes.

Step #4: Burning tests in a beaker with a paper or cloth were conducted to determine how well the nanoemulsion burned.

Example N

Step #1: Put the following items into ajar with a lid:

62 g Bunker Oil+Diesel (1:1 ratio)—mix well before adding into sonication 38 g Filtered Brita® Water Homogenize the above mixture for 10 mins using a homogenizer. Make sure that you get homogeneous product in this step. Bunker oil/Diesel mixture is black, so you may not get a clear nanoemulsion.

Fuel oil #4 is the mixture of Bunker Oil (Fuel #6) and Diesel (Fuel Oil #2) at 50:50 mixture.

Step #2: Do the freezing tests between 22° C. and −22° C. in freezer to determine if there is any changes.

Step #3: Burning tests in a beaker with a paper or cloth were conducted to determine how well the nanoemulsion burned.

Example O

Step #1: Put the following items into ajar with a lid:

60 g Bunker Oil+Diesel (1:1 ratio) makes Fuel #4—mix well before adding into sonication 38 g Filtered Brita® Water 0%, 0.25 wt %, 0.50 wt % and 1.00 wt % SDS in Filtered water (Four Tests Here)

2 g Hexadecane

Sonicate the above mixture for 10 mins using a 300 W Ultrasonic Processor Sonicator (Model MSK-USP-3N). Make sure that you get homogeneous product in this step. Bunker oil/Diesel mixture is black, so you may not get a clear nanoemulsion.

Fuel Oil #4 is the mixture of Bunker Oil (Fuel #6) and Diesel (Fuel Oil #2) at 50:50 mixture.

Step #2: Take 4 ml of Fuel Oil #4, put into vials, add 0, 5, 10 and 15 wt % of ethylene glycol, diesel and ethanol, and vortex/handshake for 1-2 minutes. Label all the tests properly.

Step #3: Do the freezing tests between 22° C. and −22° C. in freezer to determine if there is any changes.

Results: The above nanoemulsion was mixed well, but failed when higher concentration of SDS was added (made a thick solution). This was deemed a failed test.

Example P

Step #1: Put the following items into a glass jar with a lid:
35 g Diesel (Wichita, Kans.)
40 g Filtered Brita® Water
6 g Plantaren® 2000 N UP and Lumisorb™ PSMO-20 FGK (1:1 weight ratio)
2 g Hexadecane
2 g Ethylene Glycol Sonicate the above mixture for 10 mins using a Sonics® 130 W Ultrasonic Processor Sonicator (Model VCX 130 PB) at 20% power. Make sure that you get homogeneous milky product in this step.

Step #2: Take 10 ml mixture of the Plantaren® 2000 N UP and Lumisorb™ PSMO-20 FGK (1:1 ratio), weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used.

As soon as you see the clear nanofuel, stop adding these surfactants, and find out the actual weights of Plantaren® 2000 N UP and Lumisorb™ PSMO-20 FGK.

Step #3: Take 4 ml of mixture, put into vials, add 0, 5, 10 and 15 wt % of ethylene glycol, and vortex/handshake for 1-2 minutes.

Step #4: Freezing tests between 22° C. and −22° C. in a freezer were conducted to determine presence of turbidity/cloudiness, phase separation, and viscosity changes.

Step #5: Burning tests in a beaker with a paper or cloth were conducted to determine how well the nanoemulsion burned.

Example Q

Step #1: Take 4 g of mixture, put into vials, and add drop wise 0, 0.5, 1.0 and 1.5 g of ethylene glycol, ethanol and pure diesel separately into the vials while stirring (magnetic bar) on a hot plate. Let's compare all the tests each other. Total tests will be 10.

Step #2: Freezing tests between 22° C. and −22° C. in a freezer were conducted to determine presence of turbidity/cloudiness, phase separation, and viscosity changes.

Step #3: Burning tests in a beaker with a paper or cloth were conducted to determine how well the nanoemulsion burned.

Example R

Step #1: Put the following items into a glass jar with a lid:
35 g Diesel (QT Station®, Wichita, Kans.)
40 g Filtered Brita® Water
6 g Triton X-100+Span 80+Tween 80 solution (prepare a mixture of Triton X-100+Span 80+Tween 80 at 1:1:1 weight ratio)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous milky product in this step. We can replace Triton X-100, Span 80 and Tween 80 with other alternatives later.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used.

As soon as you see the clear nanofuel, stop adding these surfactants, and find out the actual weights of diesel and Triton X-100 and Span 80 mixture that you used in this step. Make sure that the temperature of the solution in the sonicator is not too high.

Step #3: Take 4 ml of mixture, put into vials, add 0, 5, 10 and 15 wt % of ethylene glycol, and vortex/handshake for 1-2 minutes.

Step #4: Freezing tests between 22° C. and −22° C. in a freezer were conducted to determine presence of turbidity/cloudiness, phase separation, and viscosity changes.

Step #5: Burning tests in a beaker with a paper or cloth were conducted to determine how well the nanoemulsion burned.

Example S

Step #1: Put the following items into a glass jar with a lid:
35 g Diesel (QT Station®, Wichita, Kans.)
40 g Filtered Brita® Water
3 g Triton X-100+Span 80+Tween 80 solution (prepare a mixture of Triton X-100+Span 80+Tween 80 at 1:1:1 weight ratio)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous milky product in this step. We can replace Triton X-100, Span 80 and Tween 80 with other alternatives later.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used.

As soon as you see the clear nanofuel, stop adding these surfactants, and find out the actual weights of diesel and Triton X-100 and Span 80 mixture that you used in this step. Make sure that the temperature of the solution in the sonicator is not too high.

If you see some cloudiness on the nanofuel, please sonicate second or third times.

Step #3: Take 4 ml of mixture, put into vials, add 0, 5, 10 and 15 wt % of ethylene glycol, and vortex/handshake for 1-2 minutes.

Step #4: Freezing tests between 22° C. and −22° C. in a freezer were conducted to determine presence of turbidity/cloudiness, phase separation, and viscosity changes.

Step #5: Burning tests in a beaker with a paper or cloth were conducted to determine how well the nanoemulsion burned.

Example T

Step #1: Put the following items into a glass jar with a lid
35 g Diesel (QT Station®, Wichita, Kans.)
40 g Filtered Brita® Water
3 g Triton X-100+Span 80+Tween 80 solution (prepare a mixture of Triton X-100+Span
80+Tween 80 at 1:1:1 weight ratio)
1 g Hexadecane
1 g Ethylene Glycol Sonicate the above mixture for 5 mins using a 300 W Ultrasonic Processor Sonicator (Model MSK-USP-3N). Make sure that you get homogeneous milky product in this step.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used. Make sure that the 300 W Ultrasonic Processor Sonicator (Model MSK-USP-3N) works well in both steps.

As soon as you see the clear nanofuel, stop adding these surfactants, and find out the actual weights of diesel and Triton X-100 and Span 80 mixture that you used in this step.

If you see some cloudiness on the nanofuel, please sonicate second and third times to make them clear and stable.

Step #3: Take 4 ml of mixture, put into vials, add 0, 5, 10 and 15 wt % of ethylene glycol, and vortex/handshake for 1-2 minutes.

Step #4: Freezing tests between 22° C. and −22° C. in a freezer were conducted to determine presence of turbidity/cloudiness, phase separation, and viscosity changes.

Step #5: Burning tests in a beaker with a paper or cloth were conducted to determine how well the nanoemulsion burned.

Example U

Step #1: Put the following items into a glass jar with a lid:
35 g Bunker Oil (Bomin® Bunker Oil Corp, TX)
40 g Filtered Brita® Water
3 g Triton X-100+Span 80+Tween 80 solution (prepare a mixture of Triton X-100+Span
80+Tween 80 at 1:1:1 weight ratio)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous product in this step. Bunker oil is black, so you may not get clear nanoemulsion.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). During the sonication, pay attention about the color changes in the nanoemulsion.

Step #3: Take 4 ml of mixture, put into vials, add 0, 5, 10 and 15 wt % of ethylene glycol, and vortex/handshake for 1-2 minutes.

Step #4: Do the freezing tests between 22° C. and −22° C. in freezer to determine if there is any changes.

Step #5: Burning tests in a beaker with a paper or cloth were conducted to determine how well the nanoemulsion burned.

Example V

Step #1: Put the following items into a glass jar with a lid:
40 g Bunker Oil (Bomin® Bunker Oil Corp, TX)
40 g Filtered Brita® Water
3 g Triton X-100+Span 80+Tween 80 solution (prepare a mixture of Triton X-100+Span
80+Tween 80 at 1:1:1 weight ratio)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous product in this step. Bunker oil is black, so you may not get clear nanoemulsion.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). During the sonication, pay attention about the color changes in the nanoemulsion.

Step #3: Take 4 ml of mixture, put into vials, add 0, 5, 10 and 15 wt % of ethylene glycol, and vortex/handshake for 1-2 minutes.

Step #4: Do the freezing tests between 22° C. and −22° C. in freezer to determine if there is any changes.

Step #5: Burning tests in a beaker with a paper or cloth were conducted to determine how well the nanoemulsion burned.

Example W

Step #1: Put the following items into a glass jar with a lid:
45 g Bunker Oil (Bomin® Bunker Oil Corp, TX)
40 g Filtered Brita® Water
3 g Triton X-100+Span 80+Tween 80 solution (prepare a mixture of Triton X-100+Span
80+Tween 80 at 1:1:1 weight ratio)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous product in this step. Bunker oil is black, so you may not get clear nanoemulsion.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). During the sonication, pay attention about the color changes in the nanoemulsion.

Step #3: Take 4 ml of mixture, put into vials, add 0, 5, 10 and 15 wt of ethylene glycol, and vortex/handshake for 1-2 minutes.

Step #4: Do the freezing tests between 22° C. and −22° C. in freezer to determine if there is any changes.

Step #5: Burning tests in a beaker with a paper or cloth were conducted to determine how well the nanoemulsion burned.

Example X

Step #1: Put the following items into a glass jar with a lid:
55 g Bunker Oil (Bomin® Bunker Oil Corp, TX)

40 g Filtered Brita® Water
3 g Triton X-100+Span 80+Tween 80 solution (prepare a mixture of Triton X-100+Span 80+Tween 80 at 1:1:1 weight ratio)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous product in this step. Bunker oil is black, so you may not get clear nanoemulsion.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). During the sonication, pay attention about the color changes in the nanoemulsion.

Step #3: Take 4 ml of mixture, put into vials, add 0, 5, 10 and 15 wt % of ethylene glycol, and vortex/handshake for 1-2 minutes.

Step #4: Do the freezing tests between 22° C. and −22° C. in freezer to determine if there is any changes.

Step #5: Burning tests in a beaker with a paper or cloth were conducted to determine how well the nanoemulsion burned.

Example Y

Step #1: Put the following items into a glass jar with a lid:
60 g Bunker Oil (Bomin® Bunker Oil Corp, TX)
38 g Filtered Brita® Water
0, 0.25 wt %, 0.50 wt % and 1.00 wt % SDS in Filtered water (Four Tests Here)
2 g Hexadecane Sonicate the above mixture for 10 mins using a 300 W Ultrasonic Processor Sonicator (Model MSK-USP-3N). Make sure that you get homogeneous product in this step. Bunker oil is black, so you may not get a clear nanoemulsion.

Step #2: Take 4 ml of mixture, put into vials, add 0, 5, 10 and 15 wt % of ethylene glycol, diesel and ethanol, and vortex/handshake for 1-2 minutes. Label all the tests properly.

Step #3: Do the freezing tests between 22° C. and −22° C. in freezer to determine if there is any changes.

Results: The above emulsion was mixed well but failed when higher concentrations of SDS was added (made a thick solution). This was deemed a failed test.

Example Z

Step #1: Put the following items into a glass jar with a lid:
59 g Bunker Oil (Bomin® Bunker Oil Corp, TX)
35 g Filtered Brita® Water
4.5 g Triton X-100+Span 80+Tween 80 solution (mixture of Triton X-100+Span 80+Tween 80 at 1:1:1 weight ratio)
1.5 g Hexadecane Sonicate the above mixture for 10 mins using a sonicator. Make sure that you get homogeneous product in this step. Bunker oil is black, so you may not get clear nanoemulsion.

Step #2: Observe any phase changes for 1-2 weeks

Step #3: Do the freezing tests between 22° C. and −22° C. in freezer to determine if there is any changes.

Results: The above emulsion was mixed well, and test results were good (clear and stabile nanoemulsion). This was deemed a successful test.

Example AA

Step #1: Put the following items into a glass jar with a lid:
60 g Diesel (Wichita, Kans.)
38 g Filtered Brita® Water
0, 0.50 wt %, 1.00 wt % and 2.00 wt % SDS in Filtered water (Four Tests Here)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous milky product in this step.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used.

As soon as you see the clear nanofuel, stop adding these surfactants, and find out the actual weights of diesel and Triton X-100 and Span 80 mixture that you used in this step. Make sure that the temperature of the solution in the sonicator is not too high.

Step #3: Freezing tests between 22° C. and −22° C. in a freezer were conducted to determine presence of turbidity/cloudiness, phase separation, and viscosity changes.

Step #4: Burning tests in a beaker with a paper or cloth were conducted to determine how well the nanoemulsion burned.

Example AB

Step #1: Put the following items into a glass jar with a lid:
60 g Diesel (Wichita, Kans.)
36 g Filtered Brita® Water
0, 1, 2 and 4 g Dimethyl Sulfoxide (DMSO) (Four Tests Here)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous milky product in this step.

Note that when we add more than 40 wt % of water into diesel, burning of the nanoemulsion fuel is slower and ignition time drops.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used.

As soon as you see the clear nanofuel, stop adding these surfactants, and find out the actual weights of diesel and Triton X-100 and Span 80 mixture that you used in this step. Make sure that the temperature of the solution in the sonicator is not too high.

Step #3: Freezing tests between 22° C. and −22° C. in a freezer were conducted to determine presence of turbidity/cloudiness, phase separation, and viscosity changes.

Step #4: Burning tests in a beaker with a paper or cloth were conducted to determine how well the nanoemulsion burned.

Example AC

Step #1: Put the following items into a glass jar with a lid:
44 g Diesel (Wichita, Kans.)
40 g Filtered Brita® Water
2 g Tween 80
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous milky product in this step. Tween 80 can be replaced with other alternatives if desired.

Step #2: Take 10 ml mixture of the Triton X-100+Span 80 solution (1:1 ratio), weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used.

As soon as you see the clear nanofuel, stop adding these surfactants, and find out the actual weights of Triton X-100 and Span 80 mixture that you used in this step. Make sure that the temperature of the solution in the sonicator is not too high.

Step #3: Freezing tests between 22° C. and −22° C. in a freezer were conducted to determine presence of turbidity/cloudiness, phase separation, and viscosity changes.

Step #4: Burning tests in a beaker with a paper or cloth were conducted to determine how well the nanoemulsion burned.

Example AD

Step #1: Put the following items into a glass jar with a lid:
62 g Bunker Oil (Bomin® Bunker Oil Corp, TX)
38 g Filtered Brita® Water Sonicate the above mixture for 10 mins using a 300 W Ultrasonic Processor Sonicator (Model MSK-USP-3N). Make sure that you get homogeneous product in this step. Bunker oil is black, so you may not get a clear nanoemulsion.

Step #2: Do the freezing tests between 22° C. and −22° C. in freezer to determine if there is any changes.

Results: The above nanoemulsion was mixed well, but failed after a few hours. This test was deemed a failure.

Example AE

Step #1: Put the following items into a glass jar with a lid:
60 g Bunker Oil (Bomin® Bunker Oil Corp, TX)
38 g Filtered Brita® Water
2 g liquid dishwasher soap Sonicate the above mixture for 10 mins using a 300 W Ultrasonic Processor Sonicator (Model MSK-USP-3N). Make sure that you get homogeneous product in this step. Bunker oil is black, so you may not get a clear nanoemulsion.

Step #2: Do the freezing tests between 22° C. and −22° C. in freezer to determine if there is any changes.

Step #3: Burning tests in a beaker with a paper or cloth were conducted to determine how well the nanoemulsion burned.

Results: The above emulsion was mixed well, but failed because dishwasher soap was not a good surfactant. This was deemed a failed test.

Example AF

Step #1: Put the following items into ajar with a lid:
35 g Diesel (QT Station®, Wichita, Kans.)
23 g Filtered Brita® Water
6 g Triton X-100+Span 80+Tween 80 solution (prepare a mixture of Triton X-100+Span
80+Tween 80 at 1:1:1 weight ratio)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous milky product in this step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used. As soon as you see the clear nanofuel, stop adding these surfactants, and find out the actual weights of diesel and Triton X-100 and Span 80 mixture that you used in this step. Make sure that the temperature of the solution in the sonicator is not too high.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AG

Step #1: Put the following items into a glass jar with a lid.
35 g Diesel (QT Station®, Wichita, Kans.)
13 g Filtered Brita® Water
6 g Triton X-100+Span 80+Tween 80 solution (prepare a mixture of Triton X-100+Span
80+Tween 80 at 1:1:1 weight ratio)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous milky product in this step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used. As soon as you see the clear nanofuel, stop adding these surfactants, and find out the actual weights of diesel and Triton X-100 and Span 80 mixture that you used in this step. Make sure that the temperature of the solution in the sonicator is not too high.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AH

Step #1: Put the following items into a glass jar with a lid:
35 g Diesel (QT Station®, Wichita, Kans.)

23 g Filtered Brita® Water
4 g Triton X-100+Span 80+Tween 80 solution (prepare a mixture of Triton X-100+Span
80+Tween 80 at 1:1:1 weight ratio)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous milky product in this step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used. As soon as you see the clear nanofuel, stop adding these surfactants, and find out the actual weights of diesel and Triton X-100 and Span 80 mixture that you used in this step. Make sure that the temperature of the solution in the sonicator is not too high.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AI

Step #1: Put the following items into a glass jar with a lid:
35 g Diesel (Wichita, Kans.)
13 g Filtered Brita® Water
3 g Triton X-100+Span 80+Tween 80 solution (prepare a mixture of Triton X-100+Span
80+Tween 80 at 1:1:1 weight ratio)
1 g Hexadecane
1 g Ethylene Glycol Sonicate the above mixture for 10 mins using a Sonics® 130 W Ultrasonic Processor Sonicator (Model VCX 130 PB) at 20% power. Make sure that you get homogeneous milky product in this step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used. As soon as you see the clear nanofuel, stop adding these surfactants, and find out the actual weights of diesel and Triton X-100 and Span 80 mixture that you used in this step. Make sure that the temperature of the solution in the sonicator is not too high.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AJ

Step #1 (No hexadecane): Put the following items into ajar with a lid:
35 g Diesel (QT Station®, Wichita, Kans.)
40 g Filtered Brita® Water
6 g Triton X-100+Span 80+Tween 80 solution (prepare a mixture of Triton X-100+Span 80+Tween 80 at 1:1:1 weight ratio)
0 g, 1 g, 2 g, 4 g and 8 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution, weigh them to find the actual weights, and add it drop-wise into the previous solution using a 300 W Ultrasonic Processor Sonicator (Model MSK-USP-3N). At this stage, add the surfactant solution very slowly and increase the sonication time. Increasing sonication time may cut down the amount of surfactants used. As soon as you see the clear nanofuel, stop adding these surfactants, and find out the actual weights of diesel and Triton X-100 and Span 80 mixture that you used in this step. Make sure that the temperature of the solution in the sonicator is not too high.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AK

Step #1: Put the following items into ajar with a lid:
35 g Diesel (Wichita, Kans.)
40 g Filtered Brita® Water
6 g Triton X-100+Span 80+Tween 80 solution (prepare a mixture of Triton X-100+Span 80+Tween 80 at 1:1:1 weight ratio)
1 g Ethylene Glycol Heat the mixture in ajar up to 120 F (−49 C) in an oven, and then homogenize the above mixture at 20,000 rpm for 10 mins (or high speed mixer) using a homogenizer. Make sure that you get homogeneous milky product in this step. In this step, please don't use sonication or microwave.

Step #2: Take 10 ml mixture of the Triton X-100+Span 80 solution (1:1), weigh them to find the actual weights, and add it drop-wise into the previous solution while homogenizing the solution at 20,000 rpm until clear fuel is observed. During the homogenization, pay attention about the color changes in the nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AL

Step #1: Put the following items into a glass jar with a lid:
35 g Diesel (QT Station®, Wichita, Kans.)
40 g Filtered Brita® Water
6 g Triton X-100+Span 80+Tween 80 solution (prepare a mixture of Triton X-100+Span 80+Tween 80 at 1:1:1 weight ratio)
1 g Ethylene Glycol Heat the mixture in ajar up to 120 F (−49 C) in an oven, and then mix the above mixture at 10,000 rpm for 10 mins using our high speed mixer in WH 125 (or kitchen blender). Make sure that you get homogeneous milky product in this step. In this step, please don't use sonication or microwave. Later we can use microwave and induction heater to heat up the solution.

Step #2: Take 10 ml mixture of the Triton X-100+Span 80 solution (1:1), weigh them to find the actual weights, and add it drop-wise into the previous solution while high speed mixing the solution at 10,000 rpm until clear fuel is observed. During the mixing, pay attention about the color changes in the nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AM

Step #1: Put the following items into a glass jar with a lid:
35 g Diesel (QT Station®, Wichita, Kans.)
40 g Filtered Brita® Water
6 g Triton X-100+Span 80+Tween 80 solution (prepare a mixture of Triton X-100+Span 80+Tween 80 at 1:1:1 weight ratio)
1 g Ethylene Glycol Heat up the mixture in ajar up to 120 F (−48 C) in an oven, and then sonicate for 10 mins using a 300 W Ultrasonic Processor Sonicator (Model MSK-USP-3N).

Make sure that you get homogeneous milky product in this step. Heating solution to −48 C will help us make the clear nanoemulsion faster.

Step #2: Take 10 ml mixture of the Triton X-100+Span 80 solution (1:1), weigh them to find the actual weights, and add it drop-wise into the previous solution at 48 C while sonication with our 300 W Ultrasonic Processor Sonicator (Model MSK-USP-3N) until clear fuel is observed. During the mixing, pay attention about the color changes in the nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AN

Step #1 Put the following items into a glass jar with a lid:
35 g Diesel (QT Station®, Wichita, Kans.)
15 g Filtered Brita® Water
6 g Triton X-100+Span 80+Tween 80 solution (prepare a mixture of Triton X-100+Span 80+Tween 80 at 1:1:1 weight ratio)
1 g Hexadecane (HD)
4 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N). At this stage, increase the sonication time. Increasing sonication time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AO

Step #1: Put the following items into a glass jar with a lid:
35 g Diesel (QT Station®, Wichita, Kans.)
24 g Filtered Brita® Water
6 g Triton X-100+Span 80+Tween 80 solution (prepare a mixture of Triton X-100+Span 80+Tween 80 at 1:1:1 weight ratio)
1 g Hexadecane (HD)
4 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N). At this stage, increase the sonication time. Increasing sonication time may create more stable nanoemulsion.

Step #3: Do the freezing tests between 50 C and −8 C in freezer to determine if there is any turbidity/cloudiness, phase separation, and viscosity changes.

Step #4 Burning tests in a beaker with a paper or cloth were conducted to determine how well the nanoemulsion burned.

Example AP

Step #1: Put the following items into a glass jar with a lid:
35 g Diesel (QT Station®, Wichita, Kans.)
39 g Filtered Brita® Water
6 g Triton X-100+Span 80+Tween 80 solution (prepare a mixture of Triton X-100+Span
80+Tween 80 at 1:1:1 weight ratio)
1 g Hexadecane (HD)
6 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using our big sonicator. At this stage, increase the sonication time. Increasing sonication time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AO

Step #1: Put the following items into a glass jar with a lid:
35 g Diesel (QT Station®, Wichita, Kans.)
39 g Filtered Brita® Water 6 g Triton X-100+Span 80+Tween 80 solution (prepare a mixture of Triton X-100+Span 80+Tween 80 at 1:1:1 weight ratio)
1 g Hexadecane (HD)
4 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using our big sonicator. At this stage, increase the sonication time. Increasing sonication time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AR

Step #1: Put the following items into a glass jar with a lid:
35 g Diesel (QT Station®, Wichita, Kans.)
14 g Filtered Brita® Water
6 g Triton X-100+Span 80+Tween 80 solution (prepare a mixture of Triton X-100+Span
80+Tween 80 at 1:1:1 weight ratio)
0.67 g Hexadecane (HD)
2.67 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N). At this stage, increase the sonication time. Increasing sonication time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AS

Step #1: Put the following items into a glass jar with a lid:
35 g Diesel (QT Station®, Wichita, Kans.)
39 g Filtered Brita® Water
6 g Triton X-100+Span 80+Tween 80 solution (prepare a mixture of Triton X-100+Span
80+Tween 80 at 1:1:1 weight ratio)
1.33 g Hexadecane (HD)
5.34 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using our big sonicator. At this stage, increase the sonication time. Increasing sonication time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AT

Step #1: Put the following items into a glass jar with a lid:
35 g Diesel (QT Station®, Wichita, Kans.)
14 g Filtered Brita® Water
6 g Triton X-100+Span 80+Tween 80 solution (prepare a mixture of Triton X-100+Span
80+Tween 80 at 1:1:1 weight ratio)
0.5 g Hexadecane (HD)
1 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using our big sonicator. At this stage, increase the sonication time. Increasing sonication time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AU

Step #1: Put the following items into a glass jar with a lid:
35 g Diesel (QT Station®, Wichita, Kans.)
14 g Filtered Brita® Water
3 and 5 g Triton X-100+Span 80+Tween 80 solution (prepare a mixture of Triton X-100+Span 80+Tween 80 at 1:1:1 weight ratio)
0.5 g Hexadecane (HD)
2 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using our big sonicator. At this stage, increase the sonication time. Increasing sonication time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AV

Step #1: Put the following items into a glass jar with a lid:
35 g Diesel (QT Station®, Wichita, Kans.)

14 g Filtered Brita® Water
5 g Triton X-100+Span 80+Tween 80 solution (prepare a mixture of Triton X-100+Span
80+Tween 80 at 1:1:1 weight ratio)
1 g Hexadecane (HD)
3.5 g Ethylene Glycol Sonicate the above mixture for 10 mins using a 300 W Ultrasonic Processor Sonicator (Model MSK-USP-3N). Make sure that you get homogeneous milky product in this step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N). At this stage, increase the sonication time. Increasing sonication time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AW

Step #1: Put the following items into a glass jar with a lid:
35 g Diesel (QT Station®, Wichita, Kans.)
14 g Filtered Brita® Water
5 g Triton X-100+Span 80+Tween 80 solution (prepare a mixture of Triton X-100+Span 80+Tween 80 at 1:1:1 weight ratio)
1 g Hexadecane (HD)
3.5 g Ethylene Glycol High speed homogenize the above mixture for 10 mins at 20,000 and 48 C. Make sure that you get homogeneous milky product in this step.

Step #2: Take 10 ml mixture of the Triton X-100+Span 80 solution (1:1), weigh them to find the actual weights, and add it drop-wise into the previous solution using high speed homogenization. At this stage, increase the high speed homogenization. Increasing homogenization time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AX

Step #1: Put the following items into a glass jar with a lid:
35 g Diesel (QT Station®, Wichita, Kans.)
24 g Filtered Brita® Water
6 g Triton X-100+Span 80+Tween 80 solution (prepare a mixture of Triton X-100+Span 80+Tween 80 at 1:1:1 weight ratio)
1 g Hexadecane (HD)
4 g Ethylene Glycol High speed homogenize the above mixture for 10 mins at 20,000 and 48 C. Make sure that you get homogeneous milky product in this step.

Step #2: Take 10 ml mixture of the Triton X-100+Span 80 solution (1:1), weigh them to find the actual weights, and add it drop-wise into the previous solution using high speed homogenization. At this stage, increase the high speed homogenization. Increasing homogenization time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AY

Step #1: Put the following items into a glass jar with a lid:
35 g Diesel (QT Station®, Wichita, Kans.)
39 g Filtered Brita® Water
6 g Triton X-100+Span 80+Tween 80 solution (prepare a mixture of Triton X-100+Span 80+Tween 80 at 1:1:1 weight ratio)
1.33 g Hexadecane (HD)
5.34 g Ethylene Glycol High speed homogenize the above mixture for 10 mins at 20,000 and 48 C. Make sure that you get homogeneous milky product in this step.

Step #2: Take 10 ml mixture of the Triton X-100+Span 80 solution (1:1), weigh them to find the actual weights, and add it drop-wise into the previous solution using high speed homogenization. At this stage, increase the high speed homogenization. Increasing homogenization time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AZ

Step #1: Put the following items into a glass jar with a lid:
35 g Diesel (QT Station®, Wichita, Kans.)
39 g Filtered Brita® Water
6 g Triton X-100+Span 80+Tween 80 solution (prepare a mixture of Triton X-100+Span
80+Tween 80 at 1:1:1 weight ratio)
1.33 g Hexadecane (HD)
5.34 g Ethylene Glycol
2 drops of Octanol High speed homogenize the above mixture for 10 mins at 20,000 and 48 C. Make sure that you get homogeneous milky product in this step. Cool it down to room temperature before sonication in the second step.

Step #2: Take 10 ml mixture of the Triton X-100+Span 80 solution (1:1), weigh them to find the actual weights, and add it drop-wise into the previous solution using a 300 W Ultrasonic Processor Sonicator (Model MSK-USP-3N). At this stage, increase the sonication time. Increasing sonication time may create more stable nanoemulsion.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AAA

Step #1: Put the following items into a glass jar with a lid:
35 g Diesel (QT Station®, Wichita, Kans.)

39 g Filtered Brita® Water
6 g Triton X-100+Span 80+Tween 80 solution (prepare a mixture of Triton X-100+Span
80+Tween 80 at 1:1:1 weight ratio)
1.33 g Hexadecane (HD)
5.34 g Ethylene Glycol 2 drops of Octanol High speed homogenize the above mixture for 1 minute at 20,000 and 45 C (microwave oven). Make sure that you get homogeneous milky product in this step.

Step #2: Take 12 ml mixture of the Triton X-100+Span 80 solution (1:1), weigh them to find the actual weight (about −12.5 g), add this 12.5 g into the previous solution and hand shake till temperature is reduced from 45 C to room temperature (21 C) (No sonication in this step). During the cooling and hand shaking, use ice bath (immersing the jar into water/ice mixture) to get clear nanoemulsion fuel. Make sure that don't keep the jar in the ice water longer, which may get gelated at lower temperature.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AAB

Step #1: Put the following items into a glass jar with a lid:
35 g Diesel (QT Station®, Wichita, Kans.)
14 g Filtered Brita® Water
5 g Triton X-100+Span 80+Tween 80 solution (prepare a mixture of Triton X-100+Span
80+Tween 80 at 1:1:1 weight ratio)
1 g Hexadecane (HD)
3.5 g Ethylene Glycol
2 drops of Octanol High speed homogenize the above mixture for 1 minute at 20,000 and 45 C (microwave oven). Make sure that you get homogeneous milky product in this step.

Step #2: Take 5.5 ml mixture of the Triton X-100+Span 80 solution (1:1), weigh them to find the actual weight (about −6 g), add this 6 g into the previous solution and hand shake till temperature is reduced from 45 C to room temperature (21 C) (No sonication in this step).

During the cooling and hand shaking, use ice bath (immersing the jar into water/ice mixture) to get clear nanoemulsion fuel. Make sure that don't keep the jar in the ice water longer, which may get gelated at lower temperature.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AAC

Step #1: Put the following items into a glass jar with a lid:
35 g Diesel (QT Station®, Wichita, Kans.)
24 g Filtered Brita® Water
6 g Triton X-100+Span 80+Tween 80 solution (prepare a mixture of Triton X-100+Span 80+Tween 80 at 1:1:1 weight ratio)
1 g Hexadecane (HD)
4 g Ethylene Glycol
2 drops of Octanol High speed homogenize the above mixture for 1 minute at 20,000 and 45 C (microwave oven). Make sure that you get homogeneous milky product in this step.

Step #2: Take 8.5 ml mixture of the Triton X-100+Span 80 solution (1:1), weigh them to find the actual weight (about ~9 g), add this 9 g into the previous solution and hand shake till temperature is reduced from 45 C to room temperature (21 C) (No sonication in this step). During the cooling and hand shaking, use ice bath (immersing the jar into water/ice mixture) to get clear nanoemulsion fuel. Make sure that don't keep the jar in the ice water longer, which may get gelated at lower temperature. Note that if you heat too much (above 55-60 C) with microwave oven, it destroys the nanoemulsion systems and makes the nanofuel cloudy.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AAD

Step #1: Put the following items into a glass jar with a lid:
35 g Diesel (QT Station®, Wichita, Kans.)
39 g Filtered Brita® Water
6 g Triton X-100+Span 80+Tween 80 solution (prepare a mixture of Triton X-100+Span
80+Tween 80 at 1:1:1 weight ratio)
12.5 g Triton X-100+Span 80 (1:1 weight ratio)
1.33 g Hexadecane (HD)
5.34 g Ethylene Glycol
2 drops of Octanol Step #2: Heat the above solution in the glass jar up to 45-50 C with microwave (or up to milky level temperature), and hand shake while cooling it down to 2 1 C for 4-5 minutes in an ice bath (or use freezer). It can produce stable nanoemulsions.

Step #3: Do the freezing tests between 50 C and −8 C in freezer to determine if there is any turbidity/cloudiness, phase separation, and viscosity changes.

Step #4: Burning tests in a beaker with a paper or cloth were conducted to determine how well the nanoemulsion burned.

Example AAE

Step #1: Put the following items into a glass jar with a lid:
35 g Diesel (Wichita, Kans.)
24 g Filtered Brita® Water
6 g Triton X-100+Span 80+Tween 80 solution (prepare a mixture of Triton X-100+Span
80+Tween 80 at 1:1:1 weight ratio)
9 g Triton X-100+Span 80 (1:1 weight ratio)
1 g Hexadecane (HD)
4 g Ethylene Glycol
2 drops of Octanol This test can eliminate step two process for a better prototype development.

Step #2: Heat the above solution in the glass jar up to 45-50° C. with microwave (or up to milky level temperature), and hand shake while cooling it down to 21° C. for 4-5 minutes in an ice bath (or use freezer). It can produce stable nanoemulsions.

Step #3: Do the freezing tests between 50° C. and −8° C. in freezer to determine if there is any turbidity/cloudiness, phase separation, and viscosity changes.

Step #4: Burning tests in a beaker with a paper or cloth were conducted to determine how well the nanoemulsion burned.

Example AAF

Step #1: Put the following items into a vacuum mixer jar with a lid on:

35 g Diesel (QT Station®, Wichita, Kans.)
39 g Filtered Brita® Water
6 g Triton X-100+Span 80+Tween 80 solution (prepare a mixture of Triton X-100+Span
80+Tween 80 at 1:1:1 weight ratio)
1.33 g Hexadecane (HD)
5.34 g Ethylene Glycol
2 drops of Octanol Heat it up to 50 C in microwave, and hand shake for a couple minutes.

Step #2: Add 12.5 g Triton X-100+Span 80 (1:1 weight ratio) into the previous solution at 50 C and hand shake again for a couple minutes.

Step #3: Put this solution in the Thinky® Planetary Vacuum Mixer cup, place into the Thinky® Planetary Vacuum Mixer and run at 2000 rpm, 96 kPa vacuum and 3 minutes of mixing.

Example AAG

Step #1: Put the following items into a vacuum mixer jar with a lid on:

35 g Diesel (QT Station®, Wichita, Kans.)
24 g Filtered Brita® Water
6 g Triton X-100+Span 80+Tween 80 solution (prepare a mixture of Triton X-100+Span
80+Tween 80 at 1:1:1 weight ratio)
1 g Hexadecane (HD)
4 g Ethylene Glycol
2 drops of Octanol Heat it up to 50 C in microwave, and hand shake for a couple minutes.

Step #2: Add 9 g Triton X-100+Span 80 (1:1 weight ratio) into the previous solution at 50 C and hand shake again for a couple minutes.

Step #3: This solution was placed in a Thinky® Planetary Vacuum Mixer cup, placed into the Thinky® Planetary Vacuum Mixer and run at 2000 rpm, 96 kPa vacuum for 3 minutes of mixing.

Results: The above emulsion was mixed well, and test results were as good at the beginning and then nanoemulsion got cloudy after 2-3 weeks later at room temperature. At low temperatures (0-15° C.), it got cloudy easily. This was deemed a failed test.

Example AAH

Step #1: Put the following items into a vacuum mixer jar with a lid on:

35 g Diesel (QT Station®, Wichita, Kans.)
14 g Filtered Brita® Water
5 g Triton X-100+Span 80+Tween 80 solution (prepare a mixture of Triton X-100+Span
80+Tween 80 at 1:1:1 weight ratio)
1 g Hexadecane (HD)
3.5 g Ethylene Glycol
2 drops of Octanol Heat it up to 50 C in microwave, and hand shake for a couple minutes.

Step #2: Add 6 g Triton X-100+Span 80 (1:1 weight ratio) into the previous solution at 50 C and hand shake again for a couple minutes.

Step #3: This solution was placed in a Thinky® Planetary Vacuum Mixer cup, placed into the Thinky® Planetary Vacuum Mixer and run at 2000 rpm, 96 kPa vacuum for 3 minutes of mixing.

Example AAI

Step #1: Put the following items into a vacuum mixer jar with a lid on:

35 g Diesel (QT Station®, Wichita, Kans.)
14 g Filtered Brita® Water
5 g Triton X-100+Span 80+Tween 80 solution (prepare a mixture of Triton X-100+Span
80+Tween 80 at 1:1:1 weight ratio)
3.5 g Ethylene Glycol
2 drops of Octanol Heat it up to 50 C in microwave, and hand shake for a couple minutes.

Step #2: Add 6 g Triton X-100+Span 80 (1:3 weight ratio) into the previous solution at 50 C and hand shake again for a couple minutes.

Step #3: This solution was placed in a Thinky® Planetary Vacuum Mixer cup, placed into the Thinky® Planetary Vacuum Mixer and run at 2000 rpm, 96 kPa vacuum for 3 minutes of mixing.

Note that in Test 187, 2 drops of octanol was not used because of the absence of bubbles in nanofuel.

Example AAJ

Step #1: Put the following items into a vacuum mixer jar with a lid on:

35 g Diesel (QT Station®, Wichita, Kans.)
24 g Filtered Brita® Water
6 g Triton X-100+Span 80+Tween 80 solution (prepare a mixture of Triton X-100+Span
80+Tween 80 at 1:1:1 weight ratio)
4 g Ethylene Glycol Heat it up to 50 C in microwave, and hand shake for a couple minutes.

Step #2: Add 9 g Triton X-100+Span 80 (1:2 weight ratio) into the previous solution at 50 C and hand shake again for a couple minutes.

Step #3: Put this solution in the Thinky® Planetary Vacuum Mixer cup, place into the Thinky® Planetary Vacuum Mixer and run at 2000 rpm and 96 kPa for 3 minutes of mixing. You can try other speeds, vacuums and mixing times later to get better nanofuels.

The invention claimed is:

1. A method of producing a clear nanoemulsion fuel that is 20 to 40 weight percent water comprising:

providing an oleaginous base fuel;

adding water in an amount of 20 to 40 weight percent to said resulting clear nanoemulsion fuel;

providing a first surfactant mixture comprising, in substantially equal weight ratios, polyethylene glycol tert-octylphenyl ether, sorbitan monooleate, and polyoxyethylene (20) sorbitan monooleate;

adding the first surfactant mixture to the water and the base fuel;

high-speed mixing the first surfactant mixture, water, and base fuel mixture at a temperature between 40 and 50 degrees Celsius to obtain a homogeneous milky product cooled to room temperature;

providing a second surfactant mixture comprising in substantially equal weight ratios polyoxyethylene (20) sorbitan monooleate and sorbitan monooleate;

adding the second surfactant mixture to the homogeneous milky product;

high-speed mixing the second surfactant mixture and the homogeneous milky product at a temperature between 40 and 50 degrees Celsius; and, continuing to mix the second surfactant mixture and the homogeneous milky product mixture while cooling the mixture to between 20 and 25 degrees Celsius to create said clear nanoemulsion fuel.

2. The method of claim 1 wherein the step of adding the first surfactant mixture to the water and the base fuel further comprises adding a first additive of ethylene glycol and a second additive of hexadecane.

3. The method of claim 1 wherein the resulting clear nanoemulsion fuel comprises between 20 and 40 weight percent water.

4. The nanoemulsion fuel of claim 1 wherein the base fuel is selected from the group consisting of diesel, biodiesel, gasoline, kerosene, mineral oil, synthetic oil, fuel oil, bunker oil, jet oil, and Fuel #4.

* * * * *